US005461965A

United States Patent [19]

Schwaegerle

[11] Patent Number: 5,461,965

[45] Date of Patent: Oct. 31, 1995

[54] CUSHIONED HYDRAULIC LIFT MECHANISM WITH SLOT IN CYLINDER WALL

[75] Inventor: Gary G. Schwaegerle, Cincinnati, Ohio

[73] Assignee: Reliance Medical Products, Inc., Mason, Ohio

[21] Appl. No.: 81,965

[22] Filed: Jun. 24, 1993

[51] Int. Cl.[6] ..... F15B 15/22; A47C 1/02; A61G 15/00

[52] U.S. Cl. ..... 91/408; 188/315; 297/344.19

[58] Field of Search ..... 91/408, 409; 92/82, 92/164, 171.1, 80, 163; 60/477; 267/131, 64.12; 188/315, 322.19, 300; 297/344.19; 248/188.5, 161, 631

[56] References Cited

U.S. PATENT DOCUMENTS

| | | | |
|---|---|---|---|
| 713,267 | 11/1902 | Wolf . | |
| 1,473,692 | 11/1923 | Atkinson . | |
| 1,494,135 | 5/1924 | Robison et al. . | |
| 1,570,479 | 1/1926 | Goldensky et al. . | |
| 1,575,973 | 3/1926 | Coleman . | |
| 1,963,430 | 6/1934 | Zarafu . | |
| 2,401,275 | 5/1946 | Richards et al. . | |
| 2,949,096 | 8/1960 | Ottestad et al. | 91/408 X |
| 3,036,844 | 5/1962 | Vogel . | |
| 3,324,422 | 6/1967 | Freese | 91/409 X |
| 3,386,339 | 6/1968 | Selsam | 91/408 X |
| 3,491,993 | 1/1970 | Scholin et al. . | |
| 3,694,839 | 10/1972 | Loblick | 60/477 X |
| 3,800,537 | 4/1974 | Denis | 60/477 |
| 3,959,970 | 6/1976 | Bos et al. | 60/477 |
| 4,065,112 | 12/1977 | Leskovec et al. . | |
| 4,136,521 | 1/1979 | Mendoza et al. | 60/477 |
| 4,144,713 | 3/1979 | Clark et al. | 60/477 |
| 4,244,122 | 1/1981 | Hetrick | 60/477 X |
| 4,344,594 | 8/1982 | Hirth . | |
| 4,516,805 | 5/1985 | Leeper et al. . | |
| 5,190,349 | 3/1993 | Austin, Jr. et al. . | |

*Primary Examiner*—John E. Ryznic
*Attorney, Agent, or Firm*—Wood, Herron & Evans

[57] ABSTRACT

A hydraulically operated piston apparatus including an outer cylinder having an inner telescopically received piston rod. An elongated slot forms a hydraulic fluid outlet through the wall of the cylinder adjacent the closed end of the cylinder. The piston extends from the open end of the cylinder and, in one aspect of the invention, is rigidly secured to an examination chair to provide for vertical adjustment of the chair. One end of the piston is adapted to gradually block the elongated fluid outlet slot to provide for smooth, linear deceleration of the piston to a stop at the end of its stroke.

18 Claims, 3 Drawing Sheets

65
64
12a
50
10
18
19
17
17a
47
52
13a
49
48
55
56
13
53
12
11
2
2
62
61
25
29
46
58
42a
57
58a
15
27
42
43
42b
12b
58b
63
60
59
25a
40
41
24

CUSHIONED HYDRAULIC LIFT MECHANISM WITH SLOT IN CYLINDER WALL

BACKGROUND OF THE INVENTION

The present invention relates to hydraulic lift mechanisms having a cushion or buffer feature, and more particularly to a vertically adjustable chair employing a cushioned hydraulic lift mechanism.

Past hydraulic lift mechanisms in the form of piston rod and cylinder combinations which include a series of axially spaced outlet orifices in the cylinder wall are generally known. Many different designs of such mechanisms exist in the prior art and employ a series of axially spaced outlet ports or orifices for similar reasons. One previous design is shown in U.S. Pat. No. 4,065,112 issued to Leskovec et al. and entitled Hydraulic Jack Cushioning Apparatus. Leskovec et al. show axially spaced orifices formed in the lower end of a cylinder wall. The cylinder telescopically receives a piston which sequentially passes the axially spaced orifices at the lower end of the piston stroke to provide a cushioning or decelerating effect on the piston. Under the weight of the load being lifted, the piston initially descends at a relatively rapid rate, however, this rate of descent decreases each time the lower edge of the piston covers or blocks another axially spaced orifice. Blockage of successive orifices restricts or slows down the hydraulic fluid flowing out of the cylinder and thereby slows the rate of descent of the piston.

Other examples of hydraulic deceleration devices employing similar concepts to those shown by Leskovec et al. are disclosed in U.S. Pat. Nos. 1,575,973 to Coleman and 3,491,993 to Scholin et al. Each of these patents similarly disclose piston and cylinder combinations in which the cylinder wall contains a plurality of axially spaced orifices which are successively closed off by the piston to thereby provide a decelerating effect on the piston. Each of these prior designs which utilize a plurality of axially spaced orifices provide a deceleration or cushioning effect which is nonlinear. That is, the piston will decelerate at a rate corresponding to the number of orifices left uncovered and will abruptly change to a new rate of deceleration as soon as another orifice is blocked by the piston. The effect of this nonlinear deceleration is that the piston will not smoothly decelerate to a stop but will instead descend through a series of bumping or jolting motions.

Many different designs of lift chairs used for patient examination and other purposes are also known in the prior art. These chairs employ hydraulic, electric, or other means for allowing the chair to be moved vertically, for example, during the examination of a patient by a medical professional. Hydraulic lift mechanisms have been used in the past by rigidly securing the chair to a piston rod assembly which is hydraulically operated within a cylinder at the base of the chair. One prior method of decelerating the piston of a hydraulic chair lift has been to use a pin at the lower end of the piston which fits into a slightly larger outlet port at the lower end of the piston stroke so as to restrict the outflow of hydraulic fluid from the cylinder and thereby decelerate the piston and the chair at the lower end of the stroke.

Although this known method of decelerating a vertically adjustable chair as it approaches its lowermost position successfully prevents the abrupt stop at the lower end of the stroke, it also presents certain undesirable features. First, the pin at the lower end of the piston forced the chair to be mounted at a greater than desirable height. Second, and more importantly, the pin caused the fluid outlet to go from an unrestricted state to a fully restricted state as soon as the pin entered the slightly larger outlet port. Although this sudden deceleration is more comfortable, for example, than having the piston "bottom out" at full speed, it is still felt as an abrupt stop by the person sitting in the chair.

Accordingly, there is a need for a hydraulic cushion which provides for smooth deceleration and cushioned stop at the lower end of the stroke and further for hydraulically operated lift chairs incorporating such a cushioning or deceleration feature.

SUMMARY OF THE INVENTION

To these ends, a preferred embodiment of the present invention comprises a hydraulic lift mechanism having an elongated fluid outlet slot in the wall of a cylinder. The slot is positioned such that a piston which is slidably received in the cylinder will gradually cover the slot as it approaches the end of its stroke. As more of the slot is blocked by the piston, the resistance to flow of hydraulic fluid out of the cylinder becomes greater and the piston decelerates in a substantially linear fashion. This creates a smoother deceleration of the piston than was possible with past hydraulic lift devices.

More specifically, the preferred embodiment of the invention takes the form of a single acting hydraulic lift mechanism which includes an outer reservoir which holds a supply of hydraulic fluid. The hydraulic lift mechanism further includes a base having a porting arrangement for allowing the fluid to flow between the reservoir, a fluid pump and a piston cylinder centrally mounted within the reservoir. The piston cylinder telescopically receives a piston rod having a first end which may be moved axially out of an open end of the cylinder by hydraulic fluid acting against a second end of the piston rod. The hydraulic fluid is pumped or otherwise forced into the closed end of the cylinder through an inlet port in the cylinder wall proximate the closed end thereof.

As mentioned above, the wall of the cylinder further includes an outlet port in the form of an elongated slot which is preferably substantially uniform in width and extends parallel to the axis of the cylinder proximate the closed end thereof. The fluid outlet slot communicates with an outlet port in the base of the device below the reservoir. The outlet port in the base which communicates with the fluid outlet slot leads to a dump valve via suitable fluid lines and, when the dump valve is opened, the piston rod descends within the cylinder while the fluid is dumped back into the reservoir via the dump valve. Additional porting in the base of the device is provided such that a fluid pump may be connected to the device to pump fluid from the reservoir into the cylinder to extend the piston from the cylinder.

In another aspect of the invention, the cushioned hydraulic lift mechanism is utilized in combination with a chair to provide means for raising and lowering the chair, for example, during the examination of a patient by a medical professional. To achieve this purpose, a mounting bore is provided at an upper end of the piston rod which protrudes from an upper open end of the cylinder. The cushioned hydraulic lift mechanism forms part of the base of the examination chair and is rigidly secured to an underside of the chair by suitable support structure between the chair and the upper end of the piston. It will be appreciated that the hydraulic cushion feature of the present invention provides for a smooth, linear deceleration of the chair as the piston rod and the chair reach their respective lowermost positions. The cushioned stop provided by the hydraulic lift of the present invention significantly reduces the sudden and noticeable deceleration and stop of prior lift chairs as they are brought to their lowermost positions.

Of course, the cushioned hydraulic lift mechanism of the invention may be utilized in many other applications employing hydraulic lifts, jacks, shock absorbers and the like. In any of these applications the present invention provides significant advantages over prior hydraulic devices since it achieves a smooth, substantially linear deceleration of the piston rod as it approaches the end of its stroke. Further, a modified slot is disclosed which is tapered in width such that it is wider at the end closer to an intermediate portion of the cylinder than at the end closer to the end of the cylinder. This provides more rapid deceleration as the piston gradually blocks the tapered slot from its wide end to its more narrow end.

DETAILED DESCRIPTION OF THE PREFERRED EMBODIMENTS

Figure 1:
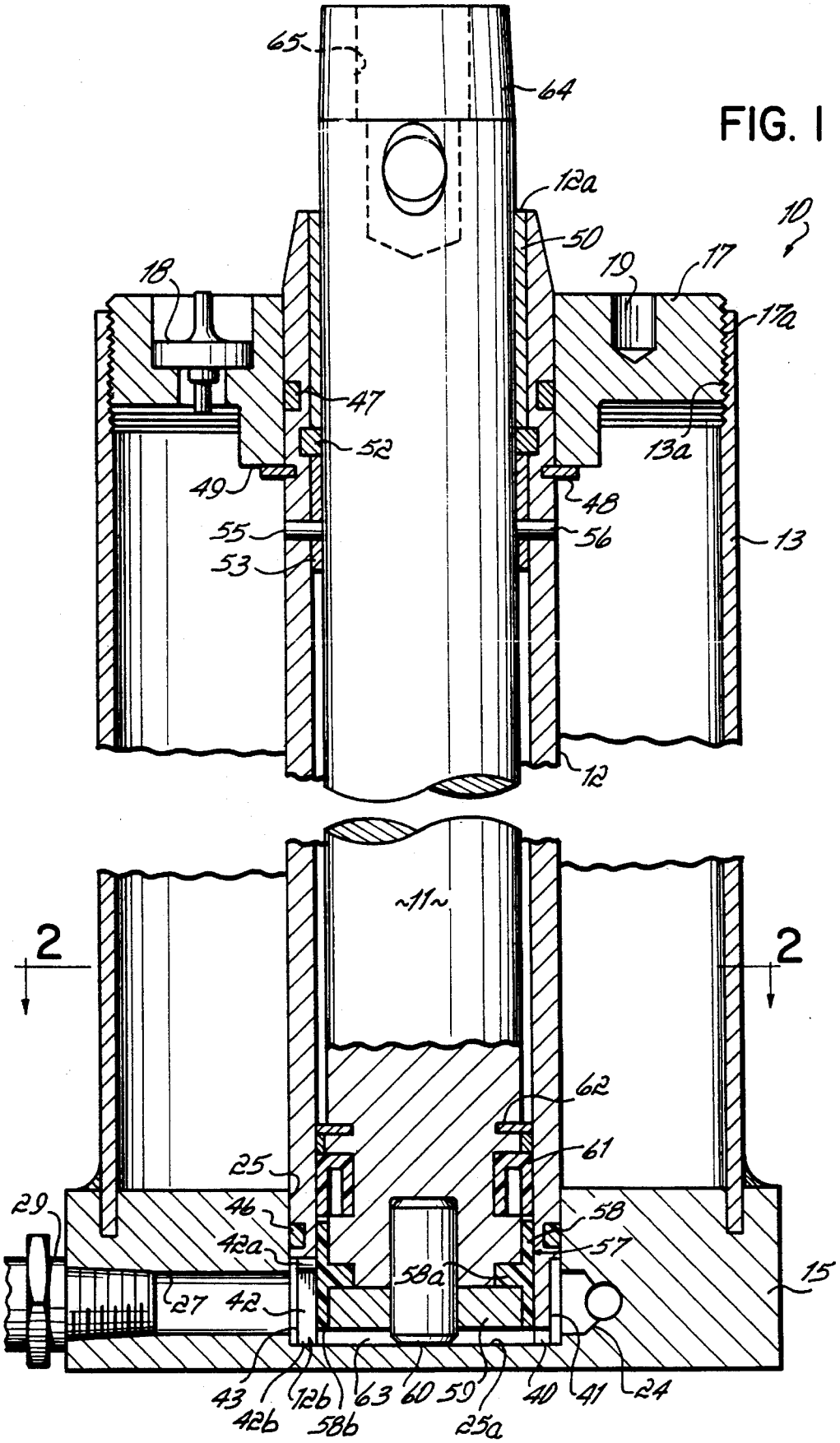
FIG. 1 is a cross-sectional view of the hydraulic lift mechanism of the present invention.

FIG. 1 illustrates a hydraulic piston apparatus 10 including a piston rod 11 telescopically received by a cylinder 12. A hydraulic fluid reservoir 13 concentrically surrounds the cylinder 12 and contains the hydraulic fluid which operates the piston rod 11. The hydraulic piston apparatus 10 further includes a base 15 having a plurality of mounting holes 16 used for mounting the apparatus 10 in an upright position. A cap 17 is provided at the end opposite the base to both close the reservoir 13 and secure the cylinder 12 within the reservoir 13 as further explained below. When the piston rod 11 is raised out of the cylinder 12, vacuum or negative pressure is created in the reservoir 13 as a result of the withdrawal of fluid therefrom. To relieve this negative or vacuum pressure, a check valve 18 is provided in the cap 17. The cap 17 also preferably includes at least two blind holes 19 for allowing the use of a spanner wrench when screwing the threads 17*a* of the cap 17 to the threads 13*a* of the reservoir 13.

Figure 2:
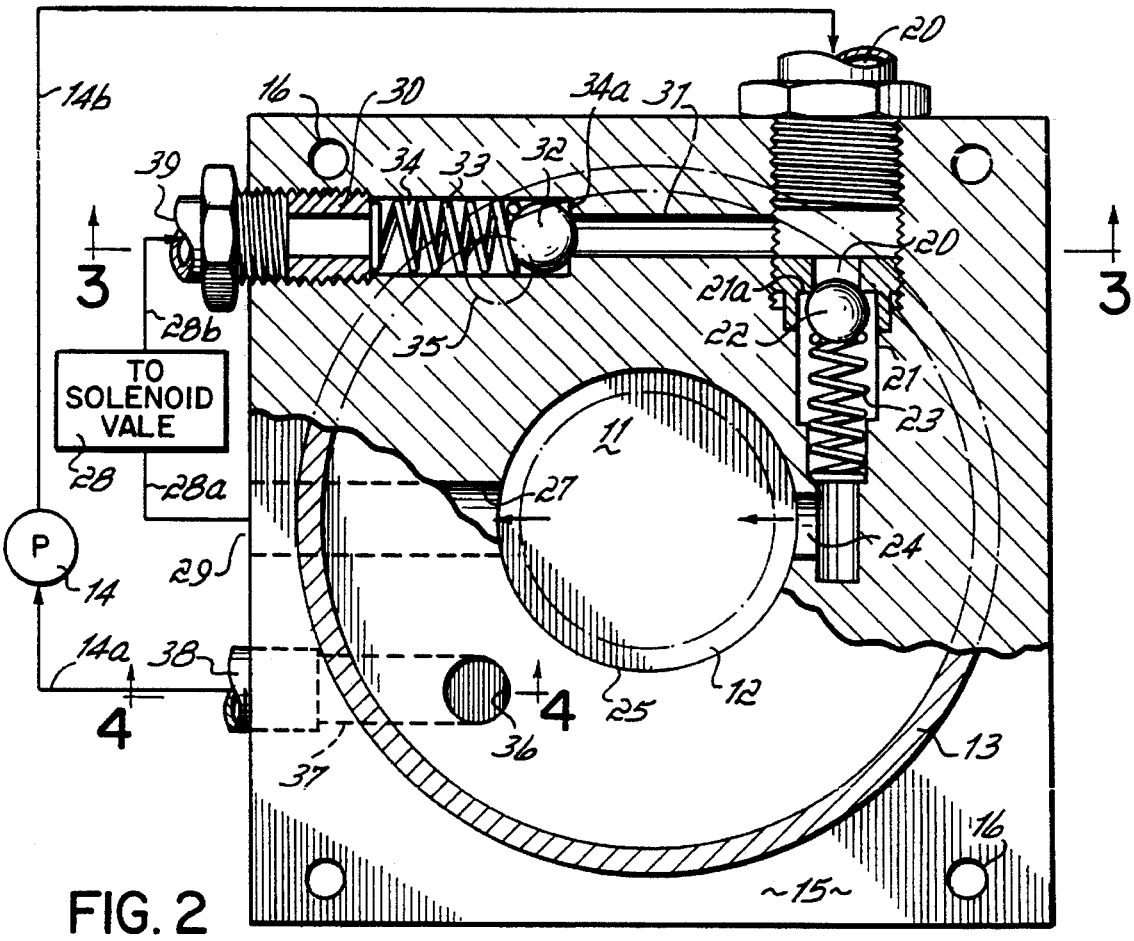
FIG. 2 is a partially fragmented top view of the base of the hydraulic lift mechanism taken along line 2—2 of FIG. 1.

As best shown in FIG. 2, the base 15 contains the porting necessary for directing hydraulic fluid from the reservoir 13 to a fluid pump 14 via fluid line 14*a*, into the cylinder 12 via fluid line 14*b*, and back to the reservoir 13 while the piston rod 11 is being extended and retracted within the cylinder 12. As also shown in FIG. 2, the base 15 includes a hydraulic fluid inlet port or passage 20 which receives pressurized hydraulic fluid from the fluid pump 14. The inlet port 20 communicates with a passage 21 which incorporates a check valve therein consisting of a ball 22 which normally rests against inwardly extending walls 21 a to normally block the passage 21 under the force of a spring 23. When pressurized hydraulic fluid enters the port 20 under enough pressure to overcome the compression force of the spring 23, the ball 22 compresses the spring 23 under the force of the fluid and allows passage of the fluid past the inwardly extending walls 21*a* and the ball 22 into the passage 21. This pressurized hydraulic fluid then enters passage 24 within the base 15 which leads to a central blind hole or recess 25 within the base 15. The blind hole 25 receives one end 12*b* of the cylinder 12 having both a fluid inlet 40 and a fluid outlet 42 as shown in FIG. 1 and further described below. By receiving the end 12*b* of the cylinder 12, the bottom surface 25*a* of the blind hole 25 effectively closes the end 12*b* of the cylinder 12.

A fluid outlet passage 27 is also formed in the base 15 and extends from the blind hole 25 to an outlet port 29 at the outer edge of the base 15. The outlet port 29 is preferably connected by way of a fluid line 28*a* to a normally closed solenoid valve 28 which is opened when it is desired to retract the piston rod 11 to allow fluid to leave the cylinder 12 under the weight of the piston rod 11 and any other objects it supports. A fluid line 28*b* connects the outlet of the solenoid valve 28 to a port 39 in the base 15 which communicates with passages 34 and 35 leading back to the fluid reservoir 13 (FIGS. 2 and 3).

Figure 3:
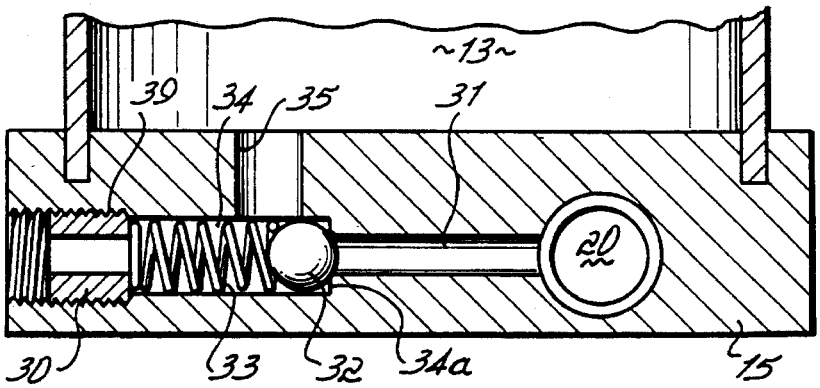
FIG. 3 is a cross-sectional view of the base pressure relief valve in the base taken along line 3—3 of FIG. 2.

As further shown in FIGS. 2 and 3, another passage 31 in the base 15 leads from the inlet passage 21 to a pressure relief valve consisting of a ball 32 blocking the fluid passage 31 under the force of a spring 33 which is held under compression in passage 34 against inwardly extending walls 34*a* by way of an adjustable set screw 30 having an internal bore 30*a*. As previously mentioned, passage 34 also communicates with port 35 which leads to the reservoir 13. The pressure relief valve formed by the ball 32 and spring 33 allows pressurized hydraulic fluid to be dumped back into the reservoir 13 when the pressure of the fluid reaches a predetermined limit which may be set by adjusting the compression in the spring 33 through inward or outward adjustment of the set screw 30. It will be appreciated that the spring force in spring 33 will always be greater than the spring force in spring 23 such that hydraulic fluid, following the path of least resistance, will always initially travel via passages 20, 21 and 24 to the inlet 40 of the cylinder 12. The pressure relief valve consisting of ball 32 and spring 33 is provided as a safety valve and is designed to open only under extreme pressure conditions as warranted by the particular design parameters and application of the device 10.

Figure 4:
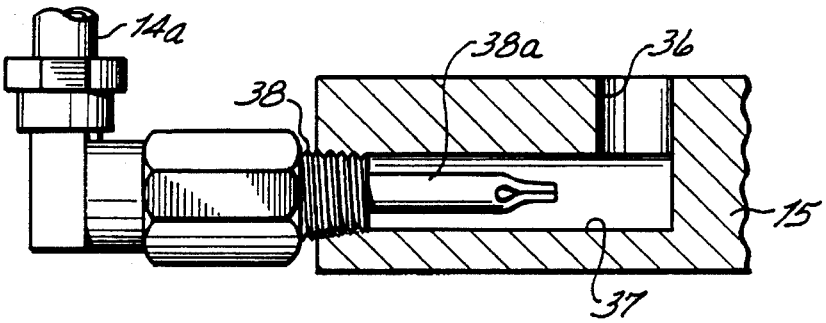
FIG. 4 is a cross-sectional view taken along line 4—4 of FIG. 2 of the base showing the fluid outlet from the reservoir.

FIG. 2 and 4 show another port 36 provided in the base 15 which extends from the reservoir 13 to a passage 37 leading to the outer edge of the base 15. This passage 37 is connected to the inlet of the fluid pump 14 by way of a fluid line 14*a*. The pump 14 draws fluid out of the reservoir 13 and pumps it into the fluid inlet 20 of the base 15 through another fluid line 14*b*. As particularly shown in FIG. 4, the passage 37 preferably includes a fitting 38 having a filter 38*a* for filtering impurities from the hydraulic fluid before it reaches the pump 14.

Figure 5:
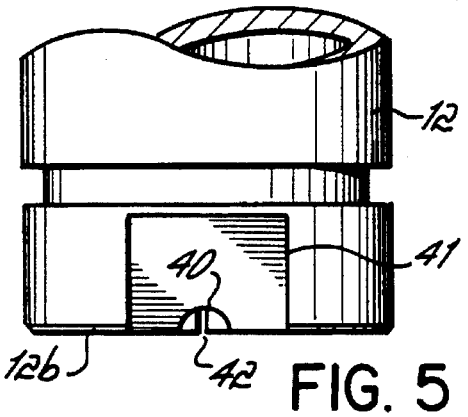
FIG. 5 is an elevated side view of the lower end of the cylinder showing the fluid inlet port and recess therein.
Figure 6:
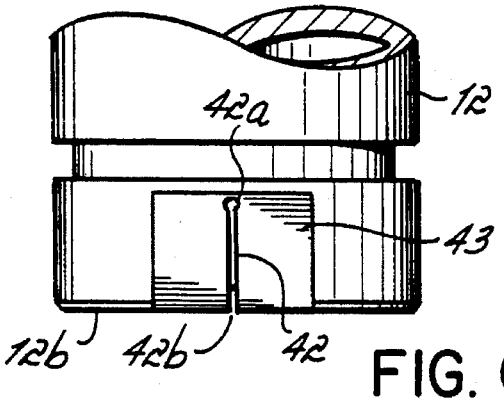
FIG. 6 is an elevated side view of the lower end of the cylinder showing the fluid outlet slot and recess therein.

Referring now to FIGS. 1, 5 and 6 the cylinder 12 includes an inlet passage or notch 40 which communicates with passage 24 in the base 15 when the cylinder end 12*b* is mounted within the blind hole 25. The inlet notch or port 40 is located at the end 12*b* of the cylinder 12. The port 40 opens to an outside surface of the cylinder 12 which includes a flat recess 41 extending around and above the inlet port 40. The flat recess 41 assures that the inlet notch or port 40 need not be exactly aligned with passage 24 in the base 15 to allow fluid communication between the passage 24 and the inlet notch or port 40. That is, as long as at least a portion of the flat recess 41 communicates with passage 24 in the base 15 a fluid path will be created between passage 24 and port 40.

The cylinder 12 further includes an elongated fluid outlet slot 42 extending inwardly along the cylinder 12 from the closed end 12*b* (FIG. 6). That is, the outlet slot 42 extends inwardly or upwardly as viewed in FIG. 6 from an open end 42*b* to a closed end 42*a* thereof. The elongated slot 42 is preferably parallel to the longitudinal axes of the piston rod 11 and cylinder 12. The outlet slot 42 is located centrally on a flat recess 43 similar to the flat recess 41. The flat recess 43 assures that the outlet port 27 in the base 15 need not be exactly aligned with the outlet slot 42 in order to allow fluid communication between the passage 27 and outlet slot 42. In addition, the flat recess 43 allows fluid to escape along the entire length of the outlet slot 43 without having the passage 27 dimensioned so as to communicate with the entire length of the outlet slot 42. That is, since there is a small amount of clearance between the side surface 25*b* of the blind hole 25 and the flat recess 43, a fluid path is created between the flat recess 43, the entire length of the slot 42 and the passage 27.

In describing the assembly of the piston rod 11 to the cylinder 12 and of the cylinder 12 to the reservoir 13, base 15, and cap 17, reference is again made to FIG. 1. A pair of respective fluid seals 46, 47 are provided on the outer diameter of the cylinder 12 to seal between the outside surface of the cylinder 12 and the blind hole 25 in the base 15 as well as between the outside surface of the cylinder 12 and the central bore 26 in the cap 17. A retaining ring 48 is connected to the outside surface of the cylinder 12 and is located inwardly of the outer seal 47. The retaining ring 48 contacts a lower surface 49 of the cap 17 when the cap is tightened down within the cylinder 13. This securely holds the cylinder 12 within the blind hole 25 in the base 15. An inner bushing or bearing 50 is rigidly secured within the open end 12*a* of the cylinder 12 to provide a bearing surface of the piston rod 11. A wiper seal 52 attached to the inner wall of the cylinder 12 is spaced inwardly from the bushing 50 and serves to prevent dirt and other material from entering the space between the bushing 50 and the piston rod 11. A mechanical stop 53 is spaced inwardly of the wiper seal 52 and is secured to the inner wall of the cylinder 12 by roll pins 55, 56.

The end of the piston rod 11, which is located proximate the closed end 12*b* of the cylinder 12 when the piston rod 11 is in a fully retracted position, includes a wear ring assembly 57. The wear ring assembly 57 preferably consists of a wear ring 58 which is attached to the end of the piston rod 11 by a disc 59 rigidly connected to the end of the piston rod 11 with a pin 60. A lip portion 58*a* of the wear ring 58 is firmly held between the disc 59 and the end of the piston rod 11. A conventional U-ring lift seal 61 is attached to the piston rod 11 and spaced inwardly of the wear ring 58. A retaining ring 62 is connected to the outside surface of the piston rod 11 inwardly of the U-ring lift seal 61 and serves as a mechanical stop on the piston rod 11 which contacts the stop 53 on the cylinder 12 as the piston rod 11 approaches the outer limit of its stroke. One end 64 of the piston rod 11 preferably protrudes from the open end 12*a* of the cylinder 12 when the piston rod 11 is in a fully retracted position. This outer end 64 of the piston rod 11 includes a means 65 for mounting various apparatus thereto. As shown, this mounting means 65 takes the form of a threaded mounting hole.

Figure 7:
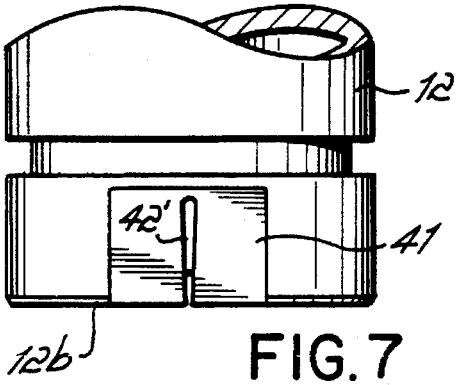
FIG. 7 is an elevated side view of the lower end of the cylinder showing an alternative embodiment of the fluid outlet slot; and, FIG. 8 is a perspective view of an examination chair employing the hydraulic lift mechanism of the present invention.

It will be appreciated that other forms of elongated slots will work equally as well and may produce other desirable characteristics for certain applications. For example, instead of using an elongated slot which is substantially uniform in width along its length, as shown in FIG. 6, a tapered slot 42' having a wider inner or upper end and a narrower outer or lower end may be used as illustrated in FIG. 7. This design allows faster initial retraction of the piston rod 11 and faster deceleration of the piston rod 11 once the wear ring 58 has begun to block the tapered slot 42'.

Also, although the fluid outlet slot is preferably formed such that it extends parallel to the axes of the piston rod 11 and cylinder 12, it may also be formed such that it extends inwardly from the outer end of the cylinder 12 in a nonparallel fashion with respect to these axes and still achieve similar results.

Figure 8:
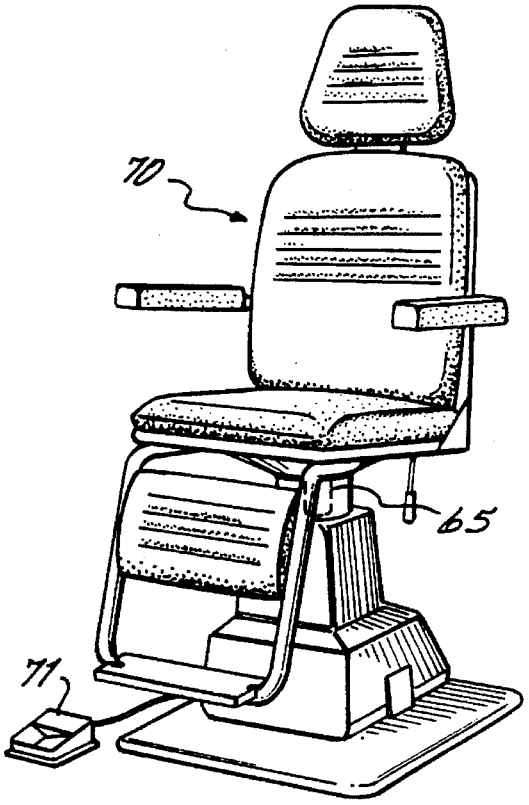

In one use of the hydraulic piston apparatus 10 of the present invention shown in FIG. 8, an examination chair 70 is rigidly mounted to the piston rod 11 by suitable support structure connected to the mounting hole 65 at the outer end of the piston rod 11.

Operation

Referring to FIGS. 1 and 2, to extend the piston rod 11 hydraulic fluid is drawn from the reservoir 13 through port 36 and passage 37 by a pump 14 which pumps the hydraulic fluid into the inlet port 20 of the base 15. This pressurized hydraulic fluid forces the ball 22 to compress the spring 23 and thus back away from the edges 21*a* of the fluid passage 21. This allows the hydraulic fluid to travel past the ball 22 and into fluid passage 24. The fluid travels through both passage 24 and inlet port or notch 40 of the cylinder 12 and into the space 63 created between disc 59 and the bottom surface 25*a* of the central blind hole 25 in the base 15. The force of this pressurized hydraulic fluid causes the piston rod 11 to move out of the cylinder 12 until either the pump 14 or hydraulic fluid is stopped or the retaining ring 62 contacts the stop 53. If the pump 14 is not stopped and hydraulic fluid continues to be pumped into the inlet 20 after the retaining ring 62 has engaged the stop 53, pressure will build up in the port 31 and, when a predetermined pressure is reached, the ball 32 will force the spring 33 to compress and the pressure will be relieved as fluid will travel through the passage 34 and port 35 into the reservoir 13 (FIG. 3).

To retract the piston rod 11 into the cylinder 12, the normally closed solenoid valve 28 is opened to allow fluid to drain out of the elongated outlet slot 42 in the cylinder 12 and into the passage 27 in the base 15. This fluid is directed through the open solenoid valve 28 by way of fluid lines 28*a*, 28*b* and into port 39 of the base 15. The fluid then travels through passages 34 and 35 back into the reservoir 13.

As the piston rod 11 approaches its fully retracted position, the wear ring 58 begins to block or cover the elongated outlet slot 42 in the cylinder 12. As more of the elongated outlet slot 42 is blocked by the wear ring 58, hydraulic fluid leaves the cylinder 12 more slowly and, as a result, the piston rod 11 decelerates. Thus, as soon as the wear ring 58 passes the inner or upper end 42*a* of the elongated fluid outlet slot 42, the piston rod 11 begins to decelerate. This deceleration continues in a substantially linear fashion until the pin 60 contacts the bottom surface 25*a* of the blind hole 25. By this point, however, the piston rod 11 has slowed to such an extent that it comes to a very gentle stop. It will be appreciated that the spacing 63 between the disc 59 and the bottom surface 25*a* of blind hole 25 has been exaggerated for illustrative purposes. In practice, the space 63 will be as small as practicable such that as much of the slot 42 is blocked as possible before the pin 60 contacts the bottom surface 25*a* of the blind hole 25.

Also, although the hydraulic piston apparatus 10 has been shown in a preferred embodiment wherein the piston rod 11 is oriented vertically for lifting operations, it will be appreciated that the apparatus 10 may be easily modified by those of ordinary skill such that the piston rod 11 operates either horizontally or at some angle to the horizontal while still realizing the advantages of the present invention.

Numerous other modifications of the present invention will become readily apparent to those of ordinary skill and applicant intends to be bound only by the scope of the claims appended hereto.

I claim:

1. In a chair including a hydraulically operated piston apparatus for adjusting the height of said chair, said hydraulic lift mechanism including an outer cylinder having outlet port means extending through a wall of the cylinder for allowing hydraulic fluid to exit the cylinder and an inner telescoping piston rod received by said cylinder and having an upper end extending from an open end of said cylinder and being rigidly secured to said chair, the improvement comprising:

said outlet port means comprising an elongated slot adapted to be gradually blocked by said piston as said piston moves axially toward one end of said cylinder.

2. The chair of claim 1 wherein said elongated slot is substantially uniform in width.

3. The chair of claim 1 wherein said elongated slot tapers in width from a first end thereof to a second end thereof.

4. The chair of claim 1 wherein said cylinder includes a longitudinal axis and said elongated slot extends substantially parallel to said longitudinal axis.

5. The chair of claim 1 wherein said cylinder further includes a closed end, said elongated slot being located proximate said closed end.

6. The chair of claim 5 further comprising:

a fluid reservoir surrounding said cylinder; and a base attached to said fluid reservoir and including fluid ports for allowing fluid to pass between said fluid reservoir and a pump motor and between said cylinder and said fluid reservoir.

7. The chair of claim 6 wherein said slot opens to a flat area on an outside surface of said cylinder, said flat area disposed adjacent a fluid port in said base for allowing fluid to pass between said cylinder and said fluid reservoir.

8. A method of operating a chair which is movable by a hydraulic piston apparatus, wherein said hydraulic piston apparatus includes a piston and piston rod connected for movement with said chair, said piston and piston rod being telescopically received in a cylinder and being extendable from and retractable into said cylinder by hydraulic fluid respectively filling said cylinder through an inlet port and draining from said cylinder through an outlet port extending through a wall of the cylinder and shaded as an elongate slot, the method comprising the step of:

moving said chair by filling said cylinder with hydraulic fluid through said inlet port and moving said piston and piston rod with respect to said cylinder, and gradually moving said piston over said elongate slot thereby decreasing the size of said slot as said piston rod approaches the end of a stroke end bringing said chair to a cushioned stop.

9. In a hydraulically operated piston apparatus having an outer cylinder receiving an inner telescoping piston rod and having outlet port means extending through a wall of the cylinder for allowing hydraulic fluid to exit the cylinder as the piston rod moves axially within the cylinder, the improvement comprising:

said outlet port means comprising an elongated slot adapted to be gradually blocked by said piston as said piston rod moves axially toward one end of said cylinder, wherein said elongated slot tapers in width from a first end thereof to a second end thereof.

10. The hydraulically operated piston apparatus of claim 9 wherein said elongated slot tapers in width from a first end thereof to a second end thereof.

11. The hydraulically operated piston apparatus of claim 9 wherein said cylinder includes a longitudinal axis and said elongated slot extends substantially parallel to said longitudinal axis.

12. The hydraulically operated piston apparatus of claim 9 wherein said cylinder includes an open end and a closed end, said piston rod is adapted to extend out of said open end and said elongated slot is located proximate said closed end.

13. The hydraulically operated piston apparatus of claim 12 further comprising:

a fluid reservoir surrounding said cylinder; and a base attached to said fluid reservoir and including fluid ports for allowing fluid to pass between said fluid reservoir and a pump and for allowing fluid to pass between said cylinder and said fluid reservoir.

14. The hydraulically operated piston apparatus of claim 13 wherein said slot opens to a flat area on an outside surface of said cylinder, said flat area disposed adjacent a fluid port in said base for allowing fluid to pass between said cylinder and said fluid reservoir.

15. A hydraulically operated piston apparatus comprising:

a cylinder having an open end and a closed end, said cylinder including a hydraulic fluid inlet port and an elongated fluid outlet slot, said slot extending through a wall of said cylinder;

a piston telescopically received by said cylinder, at least a portion of said piston being movable out of said open end of said cylinder under the force of hydraulic fluid entering said cylinder through said inlet port, wherein said piston gradually blocks said elongated fluid outlet slot as said piston moves toward said closed end of said cylinder, a fluid reservoir surrounding said cylinder; and a base attached to said fluid reservoir and including fluid ports for allowing fluid to pass between said fluid reservoir and a pump motor and between said cylinder and said fluid reservoir;

wherein said piston is adapted to extend out of said open end of said cylinder, said elongated slot is located proximate said closed end, and said slot opens to a flat area on an outside surface of said cylinder, said flat area disposed adjacent a fluid port in said base for allowing fluid to pass between said cylinder and said fluid reservoir.

16. The hydraulically operated piston apparatus of claim 15 wherein said elongated slot is substantially uniform in width.

17. The hydraulically operated piston apparatus of claim 15 wherein said elongated slot tapers in width from a first end thereof to a second end thereof, said slot being wider at said second end which is proximate said closed end of said cylinder.

18. The hydraulically operated piston apparatus of claim 15 wherein said cylinder includes a longitudinal axis and said elongated slot extends substantially parallel to said longitudinal axis.

* * * * *

UNITED STATES PATENT AND TRADEMARK OFFICE

CERTIFICATE OF CORRECTION

PATENT NO. : 5,461,965
DATED : October 31, 1995
INVENTOR(S) : Gary G. Schwaegerle It is certified that error appears in the above-indentified patent and that said Letters Patent is hereby corrected as shown below:

Col. 4, line 5, "21 a" should be -- 21a --.

Col. 7, line 61, "shaded" should be -- shaped --.

Col. 8, line 1, "end", second occurrence, should be -- and --.

Signed and Sealed this

Twenty-sixth Day of March, 1996

*Attest:*

Bruce Lehman

BRUCE LEHMAN

*Attesting Officer*

*Commissioner of Patents and Trademarks*